US008622046B2

(12) United States Patent
Gerstner et al.

(10) Patent No.: US 8,622,046 B2
(45) Date of Patent: Jan. 7, 2014

(54) FUEL SYSTEM HAVING ACCUMULATORS AND FLOW LIMITERS

(75) Inventors: Michael D. Gerstner, Peoria, IL (US); Kenneth C. Adams, Dunlap, IL (US); Benjamin R. Tower, Varna, IL (US); Bharath Chandrashekar, Peoria, IL (US); Zhenyu Li, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 804 days.

(21) Appl. No.: 12/823,623

(22) Filed: Jun. 25, 2010

(65) Prior Publication Data

US 2011/0315117 A1 Dec. 29, 2011

(51) Int. Cl.
*F02M 63/04* (2006.01)

(52) U.S. Cl.
USPC ..... 123/447; 123/467; 123/468; 123/469

(58) Field of Classification Search
USPC ..... 701/103; 123/447, 467–469
See application file for complete search history.

(56) References Cited

U.S. PATENT DOCUMENTS

| | | | | |
|---|---|---|---|---|
| 4,648,369 | A | 3/1987 | Wannenwetsch | |
| RE33,270 | E * | 7/1990 | Beck et al. | 123/447 |
| 5,725,158 | A | 3/1998 | Klaski et al. | |
| 5,950,669 | A | 9/1999 | Fehlmann et al. | |
| 6,237,569 | B1 | 5/2001 | Stelzer et al. | |
| 6,328,883 | B1 | 12/2001 | Jensen | |
| 6,488,011 | B1 | 12/2002 | Frank et al. | |
| 6,761,149 | B2 | 7/2004 | Frank | |
| 6,789,528 | B2 | 9/2004 | Endo | |
| 6,851,412 | B2 | 2/2005 | Jay | |
| 7,182,069 | B2 | 2/2007 | Nigrin et al. | |
| 7,278,400 | B2 | 10/2007 | Denton et al. | |
| 7,305,969 | B2 | 12/2007 | Ricco et al. | |
| 7,422,001 | B2 | 9/2008 | Kaneko | |
| 7,469,680 | B2 | 12/2008 | Merchant et al. | |
| 8,336,524 | B2 * | 12/2012 | Ganser et al. | 123/469 |
| 2005/0166899 | A1 | 8/2005 | Shamine et al. | |
| 2006/0219220 | A1 * | 10/2006 | Klyza | 123/447 |
| 2008/0027625 | A1 * | 1/2008 | Kloos et al. | 701/103 |
| 2009/0320789 | A1 | 12/2009 | Lund | |

FOREIGN PATENT DOCUMENTS

| | | |
|---|---|---|
| DE | 19609799 | 9/1997 |
| DE | 10036939 | 2/2002 |
| EP | 1211407 | 6/2002 |
| EP | 1734249 | 12/2006 |
| GB | 2258890 | 2/1993 |
| WO | WO 2009/033304 | * 3/2009 |
| WO | WO 2009/063306 | 5/2009 |

* cited by examiner

*Primary Examiner* — Erick Solis
(74) *Attorney, Agent, or Firm* — Finnegan, Henderson, Farabow, Garrett & Dunner LLP

(57) ABSTRACT

A fuel system for an engine is disclosed. The fuel system may have a pump, a plurality of fuel injectors, and a plurality of fuel accumulators. Each of the plurality of fuel accumulators may be disposed at least partially within a different cylinder head of the engine in fluid communication with an associated fuel injector of the plurality of fuel injectors. Each of the plurality of fuel accumulators may also be in fluid communication with adjacent fuel accumulators of the plurality of fuel accumulators. At least one of the plurality of fuel accumulators may also be in fluid communication with the pump. The fuel system may further have a plurality of flow limiters. Each of the plurality of flow limiters may be disposed between an associated fuel accumulator of the plurality of fuel accumulators and an associated fuel injector of the plurality of fuel injectors.

20 Claims, 4 Drawing Sheets

FUEL SYSTEM HAVING ACCUMULATORS AND FLOW LIMITERS

TECHNICAL FIELD

The present disclosure is directed to a fuel system and, more particularly, to a fuel system having accumulators and flow limiters.

BACKGROUND

Common rail fuel systems typically employ multiple fuel injectors to inject highly pressurized fuel into combustion chambers of an engine. The high-pressure fuel is supplied to the fuel injectors via a common rail or manifold that is secured along a length of the engine, and individual supply lines connected between the common rail and each of the injectors. In some configurations, flow limiters can be employed in the supply passages between the common rail and each of the fuel injectors to limit fuel leakage during catastrophic injector failure or to dampen pressure oscillations caused by normal operation of the fuel injectors.

Although functionally adequate, the common rail fuel system described above can be expensive and time consuming to fabricate. In particular, because of the high pressure of the fuel passing through the common rail, the common rail is generally made from heavy solid-stock material. The solid-stock material must be gun-drilled through its entire length to form a main bore having thick walls that can withstand the elevated pressures. In addition, each intersection of the common rail with the individual supply lines must be cross-drilled into the solid-stock material, and then treated, for example by way of autofrettage, ECM, abrasive flow, etc., to help ensure hermetic sealing of the intersections with little or no process contamination. These materials and processes used in the fabrication of the common rail increase a cost and a fabrication time of the fuel system.

One attempt to address the problems described above is disclosed in U.S. Pat. No. 6,851,412 (the '412 patent) of Jay issued on Feb. 8, 2005. Specifically, the '412 patent discloses a fuel injection system having an injector nozzle for each cylinder of an engine, and a dedicated pressure accumulator in direct connection with each nozzle. The dedicated pressure accumulators replace the common rail typical of such fuel systems. Each of the pressure accumulators is arranged at least partially within a cylinder head of the engine such that the cylinder head serves as a supporting casing for the accumulators, and extends from outside the cylinder head to the injector nozzles. Each pressure accumulator comprises a longitudinally elongated body part that defines at least two separate chambers in open fluid communication with each other and bounded by a common intermediate wall. A total volume of each pressure accumulator is at least 30 times greater than the volume of fuel injected by one injector nozzle during a single combustion stroke of the engine. The pressure accumulators fluidly communicate with each other by way of a tube system external to the cylinder head, the tube system being connected to a high pressure fuel pump driven by the engine.

Although the system of the '412 patent may reduce fuel system costs by replacing the common rail with dedicated pressure accumulators, the system may still be less than optimal. In particular, the multiple chambers within each accumulator of the '412 patent may increase a complexity of the accumulators, making the accumulators expensive and time consuming to fabricate. Further, the system of the '412 patent does not provide any way to limit fuel leakage during catastrophic injector failure or to dampen pressure oscillations caused by normal operation of an injector.

The system of the present disclosure solves one or more of the problems set forth above and/or other problems of the prior art.

SUMMARY

One aspect of the present disclosure is directed to a fuel accumulator. The fuel accumulator may include a body having a first end, a second end, and a single chamber extending in a length direction of the body between the first end and the second end. The fuel accumulator may also include a cap configured to close off the first end and including a first inlet and a first outlet in fluid communication with the single chamber of the body, each of the first inlet and first outlet having a diameter. The single chamber may have a cross-sectional diameter greater than the diameters of the first inlet and the first outlet.

Another aspect of the present disclosure is directed to a flow limiter. The flow limiter may include a body having an inlet, an outlet, and a recess disposed between the inlet and the outlet. The fuel limiter may also include a first valve element disposed within the recess and configured to allow substantially unrestricted fuel flow from the inlet to the recess and to restrict fuel flow from the recess to the inlet. The fuel limiter may further include a second valve element disposed within the recess and configured to allow fuel flow from the recess to the outlet during a first condition, and to inhibit fuel flow from the recess to the outlet during a second condition.

In yet another aspect, the present disclosure is directed to fuel system for an engine. The fuel system may include a pump driven by the engine to pressurize fuel, and a plurality of fuel injectors configured to inject pressurized fuel into associated combustion chambers of the engine. Each of the plurality of fuel injectors may be located at least partially within a different cylinder head of the engine. The fuel system may also include a plurality of fuel accumulators associated with the plurality of fuel injectors. Each of the plurality of fuel accumulators may be disposed at least partially within a different cylinder head of the engine in fluid communication with an associated fuel injector of the plurality of fuel injectors and in fluid communication with adjacent fuel accumulators of the plurality of fuel accumulators. At least one of the plurality of fuel accumulators may also be in fluid communication with the pump. The fuel system may further include a plurality of flow limiters, each of the plurality of flow limiters disposed between an associated fuel accumulator of the plurality of fuel accumulators and an associated fuel injector of the plurality of fuel injectors.

DETAILED DESCRIPTION

Figure 1:
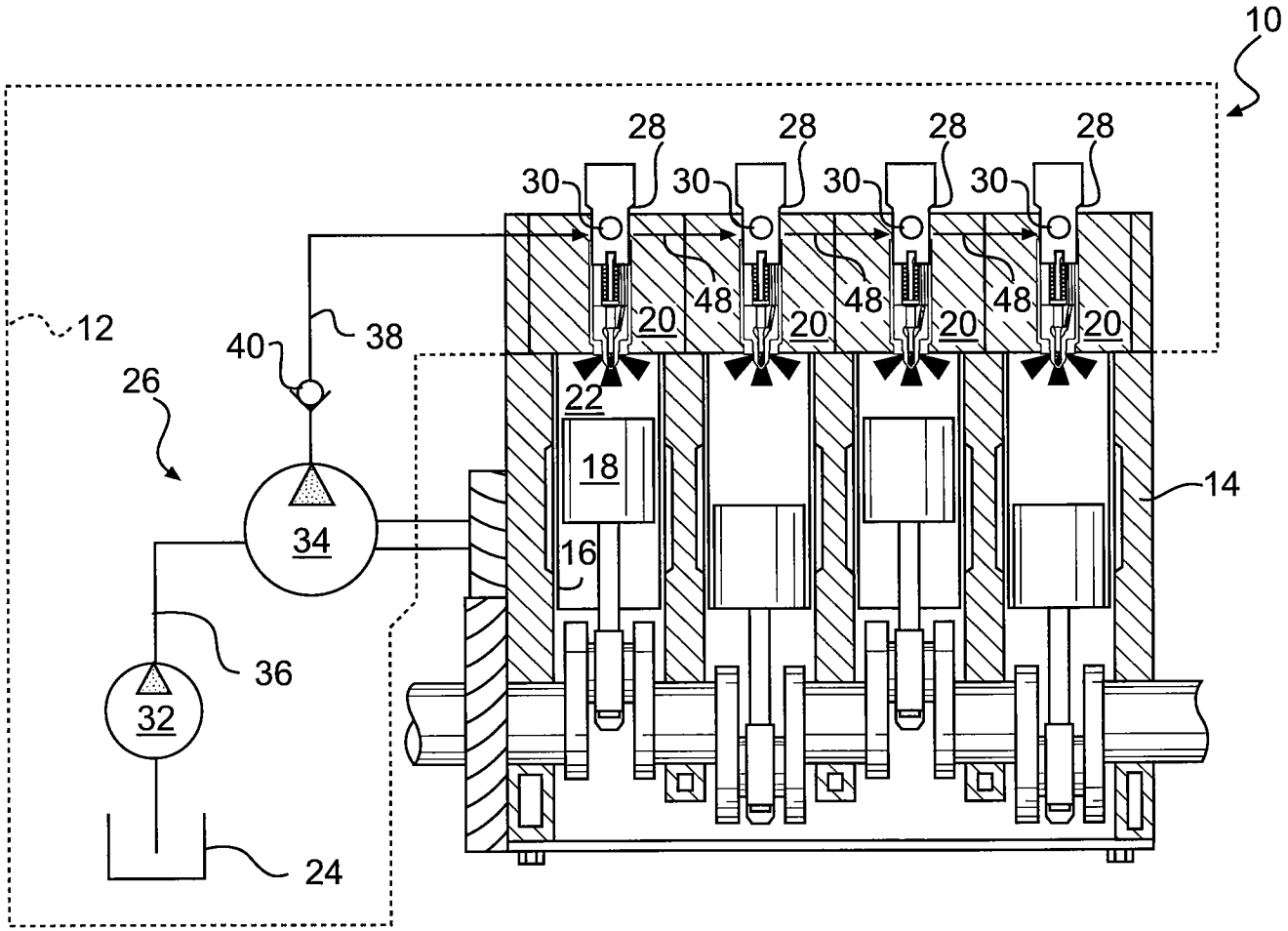
FIG. 1 is a schematic and diagrammatic illustration of an exemplary disclosed fuel system.

An exemplary embodiment of an engine 10 having a fuel system 12 is illustrated in FIG. 1. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that at least partially defines a plurality of cylinders 16, a piston 18 slidably disposed within each cylinder 16, and a cylinder head 20 associated with each cylinder 16.

Cylinder 16, piston 18, and cylinder head 20 may together form a combustion chamber 22. In the illustrated embodiment, engine 10 includes four combustion chambers 22. However, it is contemplated that engine 10 may include a greater or lesser number of combustion chambers 22 and that combustion chambers 22 may be disposed in an "in-line" configuration, a "V" configuration, or in any other suitable configuration.

Fuel system 12 may include components that cooperate to deliver injections of pressurized fuel into each combustion chamber 22. Specifically, fuel system 12 may include a tank 24 configured to hold a supply of fuel, a fuel pumping arrangement 26 configured to pressurize the fuel, and a plurality of fuel injectors 28 configured to receive the pressurized fuel by way of a plurality of distributed accumulators 30. Each fuel injector 28 may be associated with a different cylinder head 20 and be operable to inject an amount of pressurized fuel into an associated combustion chamber 22 at specific timings, fuel pressures, and fuel flow rates.

Fuel pumping arrangement 26 may include one or more pumping devices that function to increase the pressure of the fuel and direct one or more pressurized streams of fuel to accumulators 30 and fuel injectors 28. In one example, fuel pumping arrangement 26 may include a low-pressure source 32 and a high-pressure source 34 disposed in series and fluidly connected by way of a fuel line 36. Low-pressure source 32 may be a transfer pump configured to draw fuel from tank 24 and provide low-pressure feed to high-pressure source 34. High-pressure source 34 may be configured to receive the low pressure feed and increase the pressure of the fuel to, in some embodiments, about 200-400 MPa. High-pressure source 34 may be connected to accumulators 30 by way of a fuel line 38. A check valve 40 may be disposed within fuel line 38 to provide for a unidirectional flow of fuel from fuel pumping arrangement 26 to accumulators 30.

Figure 2:
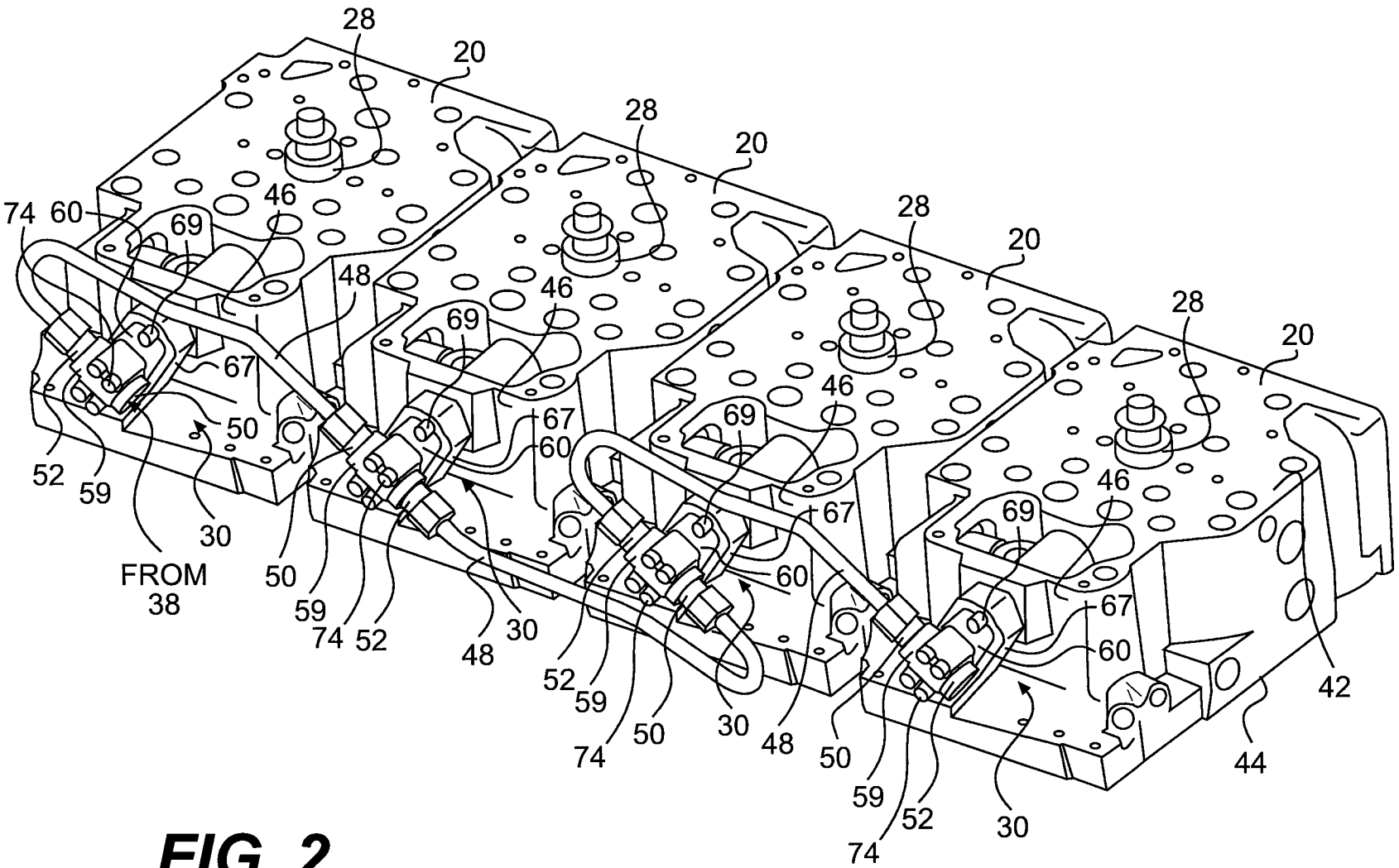
FIG. 2 is a pictorial illustration of exemplary disclosed cylinder head assemblies that may be used with the fuel system of FIG. 1.

As shown in FIG. 2, each fuel injector 28 may be paired with one accumulator 30 to receive pressurized fuel from that accumulator 30. The paired fuel injector 28 and accumulator 30 may be at least partially disposed within a common cylinder head 20, with an axial flow direction of accumulator 30 being oriented generally orthogonal to an axial flow direction of the paired fuel injector 28. Fuel injector 28 may extend from an upper surface 42 of cylinder head 20 through a lower surface 44 of cylinder head 20 and a distance into combustion chamber 22 (referring to FIG. 1). Accumulator 30 may extend from a front surface 46 of cylinder head 20 about halfway through cylinder head 20 to a location about midway along a length of fuel injector 28. Each accumulator 30 may be in fluid communication with each fuel injector 28 and with adjacent accumulators 30. In one embodiment, accumulators 30 may be daisy-chained together (i.e., fluidly connected in series) via individual supply passages 48 such that one or more of accumulators 30 may receive pressurized fuel directly from fuel line 38, and pass the fuel to its associated fuel injector 28 and to the remaining downstream accumulators 30. Although an end accumulator 30 is shown in FIG. 2 as being the accumulator 30 connected directly to fuel line 38, it is contemplated that another accumulator 30 may alternatively or additionally be connected directly to fuel line 38, if desired.

Each accumulator 30 may include an inlet 50 and an outlet 52 oriented in general oppositional alignment with each other and orthogonally to the axial flow direction of accumulator 30. The accumulator 30 located furthest upstream may have its inlet 50 fluidly connected to fuel line 38, while the accumulator 30 located furthest downstream may have its outlet 52 plugged or otherwise capped off. The remaining accumulators 30 may have their inlets 50 fluidly connected to the outlets 52 of upstream accumulators 30 by way of supply passages 48. It is contemplated that outlet 52 of the furthest downstream accumulator may alternatively be fluidly connected back to tank 24, if desired, for example by way of a pressure relief valve (not shown).

Figure 3:
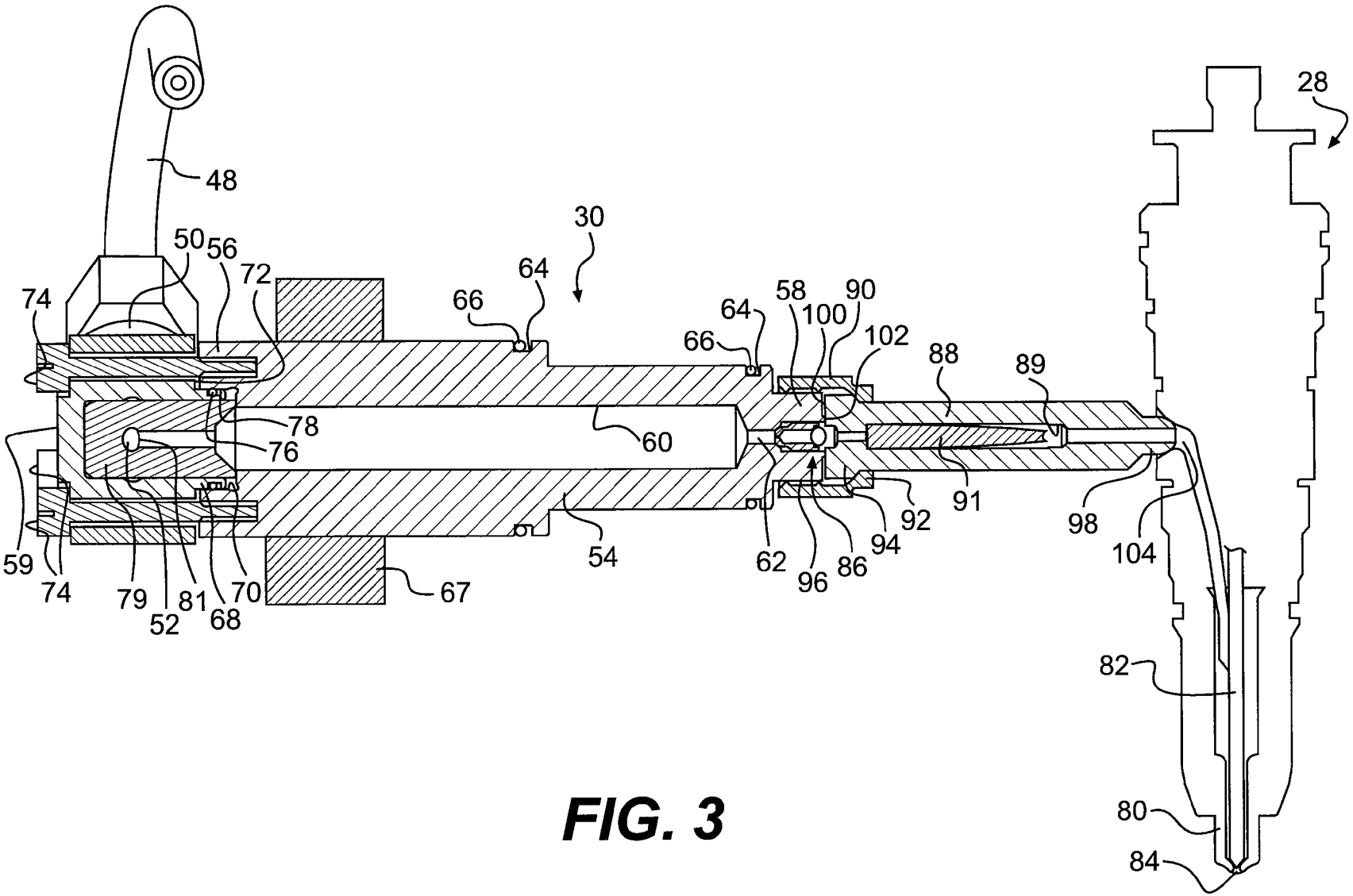
FIG. 3 is a cross-sectional illustration of an exemplary disclosed fuel accumulator that may be used with each cylinder head assembly of FIG. 2.

As shown in FIG. 3, accumulator 30 may include an elongated body 54 having a first end 56 and an opposing second end 58, and a cap 59 configured to engage and close off first end 56. A single chamber 60 may extend in the axial flow direction of body 54, between first and second ends 56, 58. Chamber 60 may be generally open at first end 56, and include an outlet 62 at second end 58. Chamber 60 may have a cross-sectional diameter greater than a diameter of outlet 62, and define a volume of about 15-50 times a maximum injection amount of injector 28 during a single cycle of engine 10 (referring to FIG. 1). Body 54 may have a generally cylindrical and stepped outer surface, with at least one external groove 64 configured to receive a sealing member 66. Sealing member 66 may be configured to engage a bore of cylinder head 20 (referring to FIGS. 1 and 2) and create a fluid seal around accumulator 30. A flange member 67 may extend from an outer surface of body 54 for engagement with front surface 46 of cylinder head 20 (referring to FIG. 2). In one embodiment, fasteners 69 (shown only in FIG. 2) may extend through flange member 67 and into cylinder head 20 to secure accumulator 30 to cylinder head 20.

Cap 59 may at least partially define inlet 50 and outlet 52, and include a generally hollow protrusion 68 orthogonal to inlet 50 and outlet 52 that is received by a recess 70 of body 54 to close off chamber 60 at first end 56. Cap 59 may also include shoulders 72 that engage first end 56, and one or more fasteners 74 that pass through cap 59 and into first end 56 of body 54 to secure cap 59 in place. A sealing member 76 may be received within an external groove 78 of protrusion 68 to create a fluid seal between cap 59 and body 54. In this manner, cap 59 may fluidly communicate inlet 50 and outlet 52 with chamber 60 via hollow protrusion 68. Chamber 60 may have a cross-sectional diameter greater than diameters of inlet 50 and outlet 52.

In one embodiment, an insert 79 may be positioned within hollow protrusion 68 and include internal passages 81 that fluidly interconnect inlet 50, outlet 52, and chamber 60. Internal passages 81 may be arranged in a general T-shape, and have smaller diameters than that of chamber 60. Insert 79 may be fabricated from a material or through a process different from those associated with cap 59, if desired. For example, insert 79 may be fabricated from a material having a higher strength and/or through a process having a higher precision. By utilizing insert 79, the cost and time associated with fabricating cap 59 may be relatively low.

Each fuel injector 28 may be a closed nozzle-type unit injector having a nozzle member 80. Nozzle member 80 may be a generally cylindrical body configured to receive a needle valve 82. One or more orifices 84 may be located at a tip end of nozzle member 80 and selectively blocked and unblocked by needle valve 82 to allow injections of pressurized fuel into an associated combustion chamber 22.

In some situations, it may be possible for a portion of nozzle member 80 to erode, crack, or completely break away. In order to inhibit unchecked fuel leakage from the damaged nozzle member 80 into combustion chamber 22 (referring to FIG. 1), a flow limiter 86 may be fluidly disposed between each accumulator 30 and each fuel injector 28. In one embodiment, flow limiter 86 may be disposed at least partially within a recess 87 of body 54 that is located at second end 58 of accumulator 30.

A coupling 90 may connect a filter housing 88 to second end 58 of accumulator 30 to close off recess 87 and thereby retain flow limiter 86 in place. Filter housing 88 may include a central passage 89 that accommodates a filter 91, for example an edge filter, that may be used to remove debris from the flow of fuel passing from accumulator 30 to injector 28. Coupling 90 may include an internal flange 92 that engages shoulders 94 of filter housing 88, and threads 96 that engage second end 58 of accumulator 30. With this configuration, a rotation of coupling 90 may serve to draw an end face 100 of filter housing 88 against a biting edge 102 of accumulator 30 to create a fluid seal. A tip end 98 of filter housing 88 may directly engage fuel injector 28 at an inlet 104 such that fuel passing from accumulator 30 through flow limiter 86 may be directed to injector 28 via central passage 89. As fasteners 69 are tightened into cylinder head 20 (referring to FIG. 2), accumulator 30 may press tip end 98 of filter housing 88 against injector 28 to create a seal at inlet 104.

Flow limiter 86 may be configured to inhibit unchecked fuel flow to a leaking fuel injector 28 in response to a pressure differential between accumulator 30 and the leaking fuel injector 28. That is, when the integrity of nozzle member 80 is compromised (e.g., when nozzle member 80 is cracked, eroded, broken, etc.), the fuel within the compromised fuel injector 28 may flow substantially unimpeded into the associated combustion chamber 22 (referring to FIG. 1). As a result of this decreased restriction to flow within the compromised fuel injector 28, the pressure of the fuel within the compromised fuel injector 28 may quickly be reduced by a significant amount. The difference in pressure between accumulator 30 and the compromised fuel injector 28 may be much greater than the difference in pressure between accumulator 30 and a properly functioning fuel injector 28. This increased pressure difference, as will be described in more detail below, may cause flow limiter 86 to actuate and inhibit fuel flow to the compromised fuel injector 28.

Figure 4:
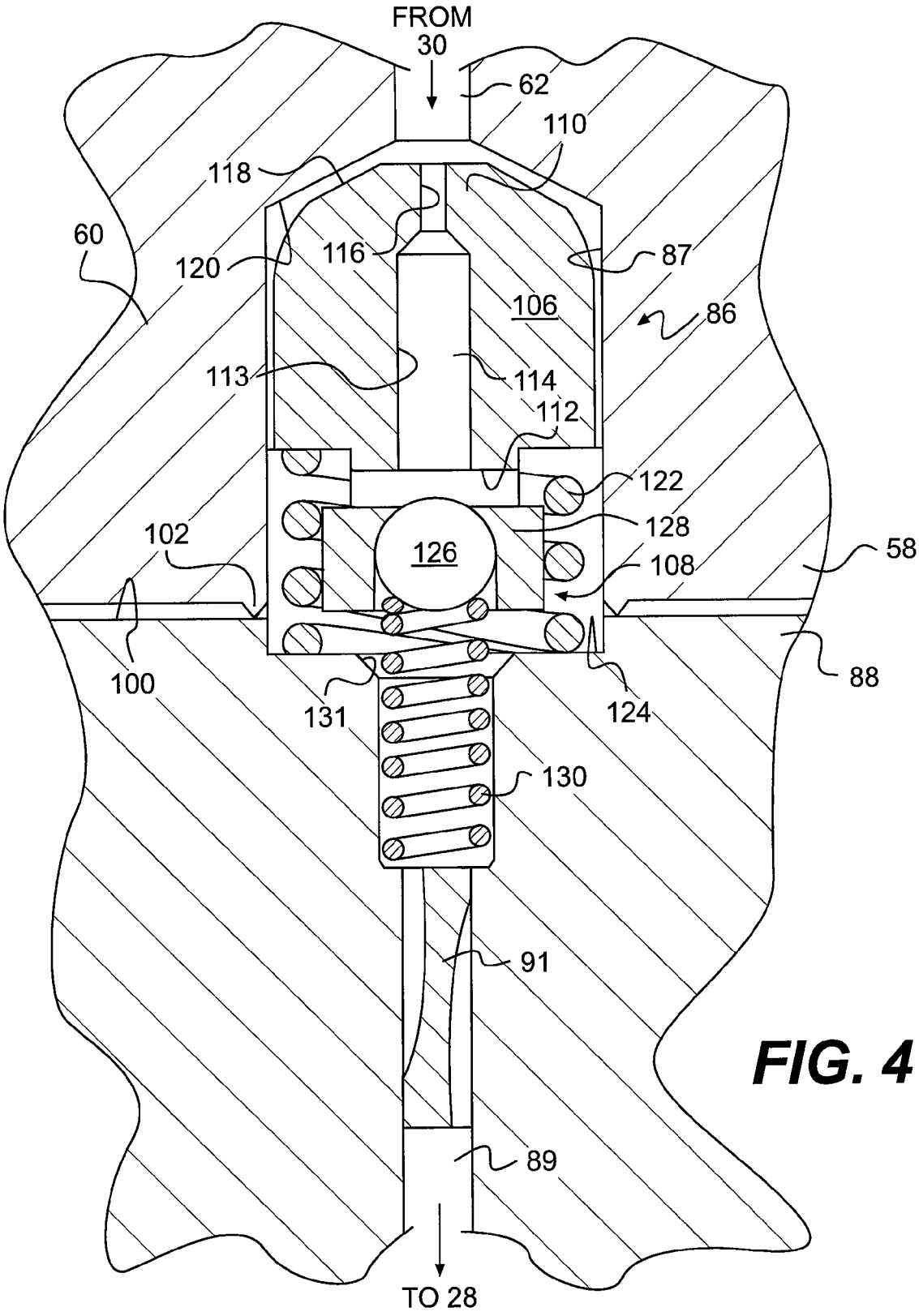
FIG. 4 is a cross-sectional illustration of a portion of the fuel accumulator of FIG. 3.

As illustrated in FIG. 4, flow limiter 86 may include multiple components that cooperate to selectively pass or block fuel flow in response to a pressure differential. Specifically, flow limiter 86 may include a first valve element 106 and a second valve element 108. First valve element 106 may be a cuplike element having a face end 110 and an open end 112. Cylindrical sidewalls 113 may extend from face end 110 to open end 112 and at least partially define an inner passage 114. A restricted orifice 116 may pass through face end 110 at a center thereof to fluidly communicate inner passage 114 with outlet 62 of accumulator 30. Face end 110 of first valve element 106 may include an external chamfer 118 configured to engage an internal chamfer 120 located at an upstream end of recess 87. A spring 122, located between open end 112 and an internal shoulders 124 of filter housing 88, may bias first valve element 106 toward a closed position at which external chamfer 118 engages internal chamfer 120. When first valve element 106 is in the closed position, fuel may only pass through restricted orifice 116. When first valve element 106 is pushed by fuel pressure to compress spring 122, fuel may pass both through restricted orifice 116 and between cylindrical sidewalls 113 of first valve element 106 and internal walls of recess 87 (i.e., when first valve element 106 is moved to an open position, fuel may flow substantially unrestricted through flow limiter 86 to injector 28).

Second valve element 108 may include a ball 126 received within a sleeve 128 of first valve element 106 and biased away from fuel injector 28 and toward accumulator 30 by a spring 130. Ball 126, sleeve 128, and spring 130 may be received within spring 122 of first valve element 106. Ball 126 may be configured to compress spring 122 during catastrophic failure of injector 28 (i.e., during a failure of injector 28 that results in a pressure gradient across flow limiter 86 greater than a threshold amount) and engage an inner conical seat 131 of filter housing 88. When ball 126 engages seat 131, little or no fuel may flow to injector 28. Under normal conditions (i.e., when a tip end of nozzle member 80 has not been compromised), ball 126 may be held away from seat 131 by the force of spring 130.

Industrial Applicability

The fuel system of the present disclosure has wide application in a variety of engine types including, for example, diesel engines, gasoline engines, and gaseous fuel-powered engines. The disclosed fuel system may be implemented into any engine that utilizes a high pressure fuel supply and closed orifice-type fuel injectors where fabrication time and cost are concerns, and flow limiting is desired. Operation of fuel system 12 will now be described in detail.

Referring to FIG. 1, during operation of fuel system 12, fuel pumping arrangement 26 may draw fuel from tank 24, pressurize the fuel, and direct the pressurized fuel to the upstream-most accumulator 30. The pressurized fuel may fill this accumulator 30 and continue to flow via supply passages 48 toward the most downstream accumulator 30. Once the pressure of the fuel within each of accumulators 30 reaches a threshold pressure, for example about 200-400 MPa, fuel injectors 28 and engine 10 may become fully operational.

Referring to FIG. 3, the pressurized fuel within accumulators 30 may flow from chamber 60 past flow limiter 86 and through filter 91 to inlet passage 104 of injector 28. Needle valve 82 may then be selectively moved away from orifices 84 at specific timings and for specific durations to inject desired amounts of the fuel into combustion chamber 22. When needle valve 82 returns and seats against the tip end of nozzle member 80, orifices 84 may be blocked and fuel injection may end.

The return of needle valve 82 against the tip end of nozzle member 80 may generate pressure oscillations within injector 28 and accumulator 30. In particular, the flow of fuel from accumulator 30 to injector 28 during an injection event may have a corresponding momentum related to the flow rate and the flow volume. The sudden closing of the needle valve 82 at the end of the injection event may instantaneously block the fuel flow and cause the corresponding momentum to rebound in the opposite direction, resulting in a reverse pressure wave traveling from injector 28 back through accumulator 30. If unaccounted for, this pressure wave could travel to adjacent accumulators 30 and interfere with subsequent injection events (i.e., the reverse traveling pressure wave could cause needle valve 82 of the same or other injectors 28 to dither and open early, close early, or open additional times).

Flow limiter 86 may help to dampen pressure oscillations within fuel system 12. Referring to FIG. 4, as the pressure wave described above travels from injector 28 back toward accumulator 30, it may first enter recess 87 of flow limiter 86. This pressure wave, together with the bias of spring 122, may urge first valve element 106 toward accumulator 30, until external chamfer 118 engages internal chamfer 120 and flow around a periphery of first valve element 106 is substantially blocked. At this point in time, the only fluid communication between flow limiter 86 and accumulator 30 may be through passage 114 and restricted orifice 116. As the pressure wave passes through restricted orifice 116 to accumulator 30, a magnitude of the pressure wave may be reduced by the associated restriction. After the pressure wave has passed through flow limiter 86, the pressure differential between accumulator 30 and injector 28 may overcome the bias of spring 122 and return first valve element 106 to the open position, at which fuel from accumulator 30 may pass both through and around first valve element 106 substantially unrestricted.

Flow limiter 86 may also inhibit fuel supply to injector 28 during catastrophic failure of injector 28. In particular, as the pressure differential between accumulator 30 and injector 28 reaches a threshold limit indicative of an injector failure condition, the pressure differential may move ball 126 against the bias of spring 130 to engage seat 131. In this position, little or no fuel may pass through flow limiter 86 to injector 28. Once the injector failure condition has been remedied, or the pressure differential across flow limiter 86 has otherwise been reduced (such as at engine shutdown), spring 130 may move ball 126 away from seat 131 to restore the flow of fuel to injector 28.

Numerous advantages of the disclosed fuel system may be realized. For example, because the disclosed fuel system utilizes simple distributed accumulators that are relatively easy to fabricate compared to traditional common rail construction, the overall cost of the fuel system may be low. In addition, the use and location of flow limiters may help to dampen pressure oscillations within the fuel system that could disrupt normal injection events, as well as inhibit fuel leakage during a failure condition of a downstream component.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the disclosure being indicated by the following claims and their equivalents.

What is claimed is:

1. A fuel accumulator, comprising:

a body having:

a first end;

a second end; and a single chamber extending in a length direction of the body between the first end and the second end; and a cap configured to close off the first end and including a first inlet and a first outlet in fluid communication with the single chamber of the body and each having a diameter, wherein the single chamber has a cross-sectional diameter greater than the diameters of the first inlet and the first outlet, wherein the cap includes:

a protrusion received by a recess in the body at the first end;

shoulders that engage the first end of the body; and a sealing member disposed within an external groove of the protrusion.

2. The fuel accumulator of claim 1, wherein:

the body includes a second outlet at the second end in fluid communication with the single chamber, the second outlet having a diameter; and the cross-sectional diameter of the single chamber is greater than the diameter of the second outlet.

3. The fuel accumulator of claim 2, wherein the first inlet and the first outlet are disposed in alignment with each other and substantially orthogonal to the single chamber.

4. The fuel accumulator of claim 1, further including an insert disposed within the cap and having fluid passages that fluidly connect the first inlet and the first outlet with each other and with the single chamber.

5. The fuel accumulator of claim 1, further including at least one sealing member received within an external groove of the body.

6. The fuel accumulator of claim 1, further including a recess located in the body at the second end and configured to receive a flow limiter.

7. The fuel accumulator of claim 6, further including threading at the second end configured to connect a filter housing to the body and close off the recess.

8. The fuel accumulator of claim 1, wherein the cap is fastened to the body, and the body includes a flange member at the first end for connection to a bore of a cylinder head.

9. A flow limiter, comprising:

a body having an inlet, an outlet, and a recess disposed between the inlet and the outlet;

a first valve element disposed within the recess and configured to allow substantially unrestricted fuel flow from the inlet to the recess and to restrict fuel flow from the recess to the inlet;

a second valve element disposed within the recess and configured to allow fuel flow from the recess to the outlet during a first condition, and inhibit fuel flow from the recess to the outlet during a second condition, a first spring configured to bias the first valve element away from the outlet; and a second spring configured to bias the second valve element away from the outlet.

10. The flow limiter of claim 9, wherein the second valve element is a ball configured to compress the second spring and engage a seat of the body at an outlet end of the recess when a pressure at the outlet is reduced.

11. The flow limiter of claim 10, wherein the first valve element includes a sleeve located within the first spring and configured to receive the ball.

12. The flow limiter of claim 10, wherein the first valve element is cuplike and includes a restricted orifice in alignment with the inlet and the outlet.

13. The flow limiter of claim 12, wherein fuel from the inlet may pass through the restricted orifice and around an exterior of the first valve element, and fuel from the outlet may pass only through the restricted orifice.

14. The flow limiter of claim 12, wherein an end of the first valve element includes an external chamfer configured to seat against an internal chamfer located at an inlet end of the recess to create a seal at a periphery of the first valve element.

15. The flow limiter of claim 9, further including a filter located at the outlet.

16. The flow limiter of claim 9, wherein the second condition is associated with failure of a downstream component that increases a pressure differential across the flow limiter.

17. A fuel system for an engine, comprising:

a pump driven by the engine to pressurize fuel;

a plurality of fuel injectors configured to inject pressurized fuel into associated combustion chambers of the engine, each of the plurality of fuel injectors being located at least partially within a different cylinder head of the engine;

a plurality of fuel accumulators associated with the plurality of fuel injectors, wherein:

each of the plurality of fuel accumulators is disposed at least partially within a different cylinder head of the engine in fluid communication with an associated fuel injector of the plurality of fuel injectors;

each of the plurality of fuel accumulators is in fluid communication with adjacent fuel accumulators of the plurality of fuel accumulators;

at least one of the plurality of fuel accumulators is also in fluid communication with the pump; and at least one of the plurality of fuel accumulators has a body with a cap, the cap including a first inlet and a first outlet, a filter being located at the outlet;

a plurality of flow limiters, each of the plurality of flow limiters disposed between an associated fuel accumulator of the plurality of fuel accumulators and an associated fuel injector of the plurality of fuel injectors.

18. The fuel system of claim 17, wherein:

each of the plurality of flow limiters is received within a recess of an associated fuel accumulator of the plurality of fuel accumulators; and the fuel system further includes a plurality of filter housings, each of the plurality of filter housings configured to engage an end and close off the recess of an associated fuel accumulator of the plurality of fuel accumulators.

19. The fuel system of claim 17, wherein the cap includes:

a protrusion received by a recess in the body at the first end;

shoulders that engage the first end of the body; and a sealing member disposed within an external groove of the protrusion.

20. The fuel system of claim 17, wherein at least one of the plurality of flow limiters includes:

a first valve element;

a second valve element;

a first spring configured to bias the first valve element away from the outlet; and a second spring configured to bias the second valve element away from the outlet.

* * * * *

UNITED STATES PATENT AND TRADEMARK OFFICE

CERTIFICATE OF CORRECTION

PATENT NO. : 8,622,046 B2
APPLICATION NO. : 12/823623
DATED : January 7, 2014
INVENTOR(S) : Gerstner et al.

It is certified that error appears in the above-identified patent and that said Letters Patent is hereby corrected as shown below:

In the Specification

Column 6, line 20, delete "Industrial Applicability" and insert -- INDUSTRIAL APPLICABILITY --.

Signed and Sealed this
Fifteenth Day of September, 2015

Michelle K. Lee

Michelle K. Lee
*Director of the United States Patent and Trademark Office*